US005531211A

United States Patent [19]

Wilfong, Jr.

[11] Patent Number: 5,531,211

[45] Date of Patent: Jul. 2, 1996

[54] ARCHERY ARM GUARD

[76] Inventor: Gary R. Wilfong, Jr., HCR 62, Box 122-B, Sedgewickville, Mo. 63781-9509

[21] Appl. No.: 333,506

[22] Filed: Nov. 2, 1994

[51] Int. Cl.[6] ..... F41B 5/00

[52] U.S. Cl. ..... 124/86; 124/25.6; 124/88

[58] Field of Search ..... 124/23.1, 24.1, 124/25.6, 86, 88, 89, 87

[56] References Cited

U.S. PATENT DOCUMENTS

| | | | |
|---|---|---|---|
| 3,167,062 | 1/1965 | Zwickey | 124/23.1 |
| 3,256,872 | 6/1966 | Koser | 124/23.1 |
| 3,599,621 | 8/1971 | Scrobell | 124/23.1 |
| 3,623,458 | 11/1971 | Crest | 124/88 X |
| 4,048,674 | 9/1977 | Chesnick | 2/16 |
| 4,054,121 | 10/1977 | Hoyt | 124/89 |
| 4,343,286 | 8/1982 | Thacker | 124/88 X |
| 4,457,287 | 7/1984 | Babinfton | 124/23.1 |
| 4,787,361 | 11/1988 | Vyprachticky | 124/88 |
| 4,788,961 | 12/1988 | Toth | 124/87 X |
| 4,836,177 | 6/1989 | Williams | 124/89 |
| 5,103,798 | 4/1992 | McGraw et al. | 124/88 |
| 5,106,044 | 4/1992 | Regard et al. | 124/23.1 X |
| 5,137,008 | 8/1992 | Taylor | 124/88 |
| 5,289,814 | 3/1994 | Maisano | 124/87 |
| 5,349,937 | 9/1994 | Burling | 124/25.6 |
| 5,413,084 | 5/1995 | Haggard | 124/44.5 |

*Primary Examiner*—Eric K. Nicholson
*Assistant Examiner*—John A. Ricci
*Attorney, Agent, or Firm*—Kalish & Gilster

[57] ABSTRACT

A device for attachment to an archery bow facilitates placement of the bow arm of the archer. The device includes a plurality of pieces adapted for attachment to the bow and which are movably interconnected to one another in such manner as to be adjustable in at least three different directions, to an individual archer's preferred position on the bow. The device permits the archer to optimally position the archer's bow-supporting arm relative to the device to enhance shooting performance and to prevent contact of the bowstring with the archer's bow-supporting arm.

17 Claims, 5 Drawing Sheets

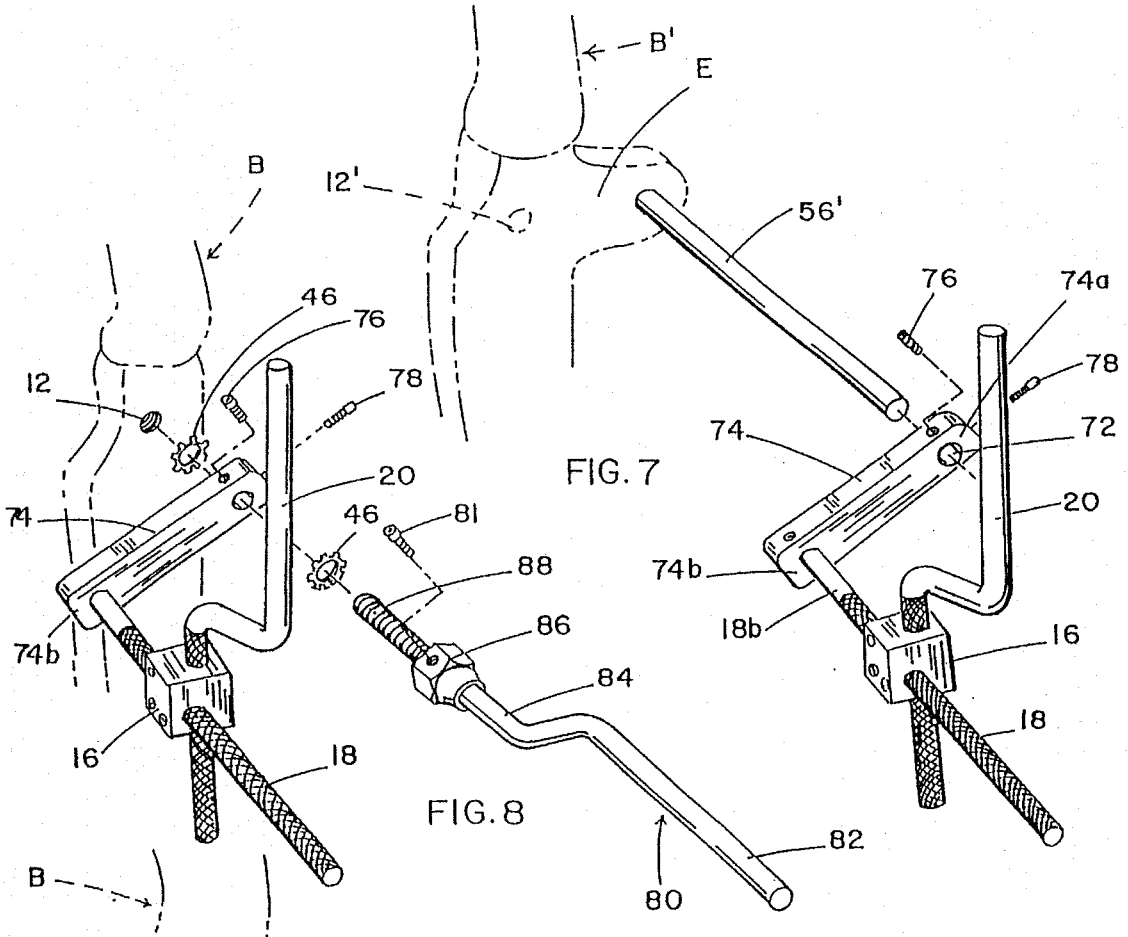
FIG. 7
FIG. 8
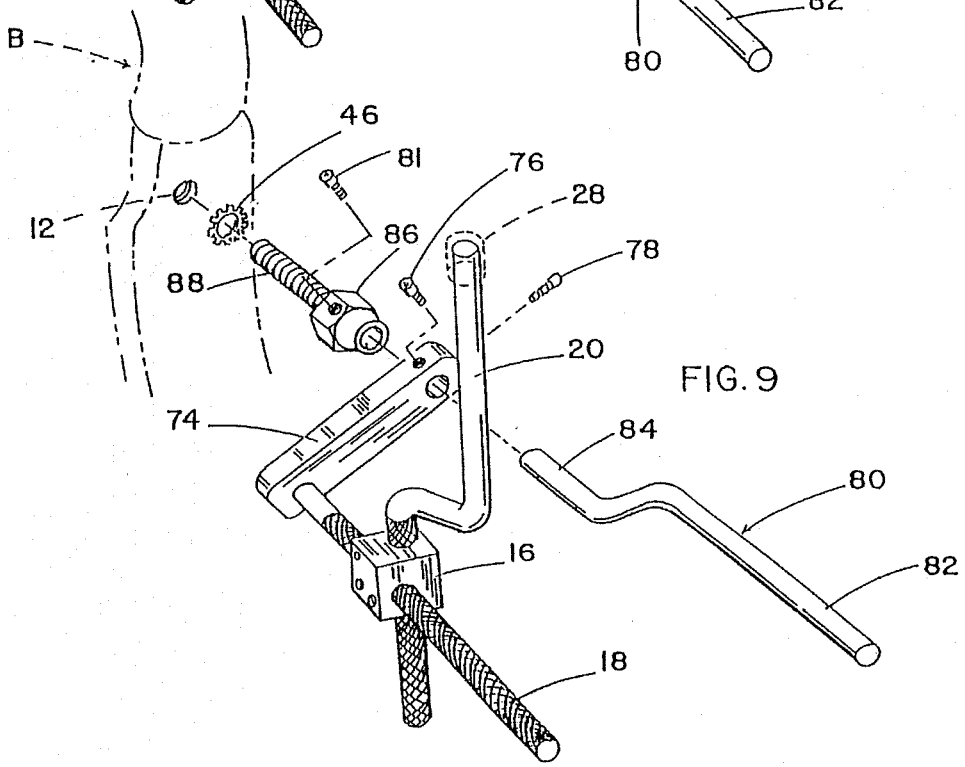
FIG. 9

ARCHERY ARM GUARD

BACKGROUND AND SUMMARY OF THE INVENTION

The present invention relates generally to the field of arm guards for use in archery, and, more particularly, to a multi-piece device for attachment to compound bows of various types. The new device is used to assist in accurate and consistent positioning of the archer's bow arm, and is adjustable in several directions for increased flexibility of use by archers of various sizes and body types.

It is well known that during use of an archery bow, and particularly bows of the compound variety, for hunting or target practice, that it is critical that the archer's bow arm be kept in an exact, preselected position. Failure to maintain the appropriate position during draw back of the bowstring, sighting and string release can result in a missed shot and/or severe scraping or "burning" of the archer's bow support arm by the recoiling strings. Thus, the new device provides a means by which the user can assure that the bow arm is correctly positioned for shooting by reference to the positional relationship between the arm supporting the bow and the new guard (or positioning device) connected thereto.

Previously, these problems have been addressed in a number of ways which have been only partially successful because the known devices could only be adjusted, if at all, in a very limited fashion. Of course, the most well known device for protecting an archer's arm is a simple piece of flexible material such as leather or plastic which can be strapped to the inside of the bow holding arm. These guards are not attached to the bow and do not serve to assist the archer in proper alignment of the arm in relation to the bow. They are merely physical barriers to prevent contact between the recoiling bowstring and the holding arm.

Some arm guards which are attachable to the bow can be shifted somewhat either vertically, laterally, or in and out (forward and back relative to the body position of the archer), but no known archery arm guard can be adjusted to the user's preference in all three of these directions, as well as being rotatable about a longitudinal axis for maximum adjustability as is the new arm guard as presently described and claimed.

It is to be understood that throughout the present application the use of the term "guard" is meant to encompass the function of being a position guide which serves to improve accuracy, as well as being a protective device in the "shield" sense of the word.

As an example, among the specific considerations concerning attachment of an archery arm guard to assist in correct arm placement is whether the archer is a "release shooter" or a "finger shooter". The latter pulling and releasing the bowstring with the bare fingers and the former using a known mechanical device commonly referred to as a "release". The metallic gripping parts of the mechanical release device require much less space for clearance around the bowstring than do the archer's fingers. So, as will be clear in view of the following description, in using the new arm positioner a release shooter may prefer to dispose the vertical bar thereof adjacent and parallel in relation to the bowstring, whereas a finger shooter necessarily needs more gripping space and may prefer to position the vertical bar slightly forwardly of the unstretched bowstring so that the bar does not interfere with finger gripping of the string. The fully adjustable aspects of the present guard permit such desirable variations in parts settings.

Examples of other factors to be considered in positioning the new guard as a guide for bow arm placement are the length, diameter and general shape of the archer's bow arm. These dimensions will necessarily affect arm position relative to the bow and bowstring, in order for the archer to avoid striking the arm with the string while maintaining proper grip and bow angle during aiming and shooting. The new guard is sufficiently adjustable to accommodate a wide range of body sizes and types, as archers include youths and women as well as adult men, and bow sizes will vary accordingly.

Also, bows vary significantly in style and shape of the arrow brace, which can vary in its position relative to the unstretched bowstring over a range of about five to about 11 inches. Thus, sufficient adjustment is provided with the new arm guard structure to accommodate most known bows, including those recently available with built-in accessory mounting rods.

It is to be noted that such addition of other accessories, for example an arrow quiver, necessarily causes the bow to be off balance, placing increased strain on the user's hand, wrist and arm. Attachment of the new arm guard has the added advantage of helping to off-set the weight of such other accessories and helps to bring the entire bow back into balance, to make holding, aiming and shooting easier and thus more accurate.

None of the known archery arm guides or guards are constructed in such a manner as to provide for such extensive adaptability of use depending upon all the above-mentioned factors. For example, U.S. Pat. No. 3,623,468, which issued to Crest, shows an arm guard for attachment to a long bow and which has a transverse bar extending outwardly to the side of the bow handle and which is secured to the bow generally below the bow handle via screws. A spacer bar extends from the transverse bar rearwardly toward the bowstring and is connected to a flat arm guard plate which extends generally upwardly and parallel to the bow string.

The vertically extending plate of the Crest arm guard is attached to the horizontally extending spacer as a single unitary piece of material which is curved and bent to an angle of about 90° . Thus, the Crest device does not include attaching the vertical plate to the horizontal piece in such a manner as to enable adjustment of these parts in relation to one another as is possible with the various independent but adjustably connectable parts of the present arm guard.

Rather, Crest permits changes in lateral positioning only by changing the length of the cylinder 54 . It does not allow actual adjustability of a given piece. Furthermore, there is no separate adjustment for the rearwardly extending spacer bar or vertical bar in its rearward or forward position, separate from other parts of the device. There is no adjustment of the spacer cylinder 54 in only a rearward or forward direction, or in a vertical or horizontal direction because elements 40 and 42 of Crest cannot rotate.

U.S. Pat. No. 5,137,008, which issued to Taylor, discloses an arm guard wherein a horizontal rearwardly extending bar is releasably mounted to the bow via an aperture generally provided below the handle of conventional compound and long bows. An arm guide plate is pivotally attached to a rearwardly extending bar so that it can be angled sideways relative to the archer's bow arm and the bowstring.

However, in the Taylor patent, there is not shown any use of a cable guard along with the arm guard on the same bow. As illustrated in FIGS. 7 and 9 of Taylor the arm guard crosses the mid-line of the bow and thus would obstruct the use of a below-the-grip cable guard which is standard on today's bows. Lateral and vertical adjustment, if any, can only be made in the Taylor device by changing the mounting arm which then moves the entire device. There is no selective adjustment of different portions of the device independently from one another.

U.S. Pat. No. 5,103,798, which issued to McGraw, discloses an arm guard provided without a vertical piece, but which merely includes a rearwardly extending rod to lie adjacent to the bow arm and which is longer than the user's forearm. McGraw uses a mounting block for attachment of the rearwardly extending rod to the bow, wherein the length of the rod may be adjusted to fit the archer. No lateral rotation is possible, nor is there provision made for vertical adjustment.

Also in McGraw, the cable guard and arm guard cannot be adjusted separately from one and other. Only slight forward and rearward adjustment is available on the McGraw device. No vertical or lateral adjustments are available at all. Moreover, McGraw does not accommodate an arm positioning device for use with a cable guard which is factory installed and of the type which will later be described herein.

None of the known archer's arm guards include the unique combination of interconnected adjustable rods and mounting cubes and blocks of the present invention, and specifically the use of two or more mounting blocks to enable independent adjustment of the position of the side rod in relation to the bow handle, adjustment of the position of the rearwardly extending rod and vertical adjustment of the rod extending parallel to the bowstring. All these features are desirable for optimum positioning for reliable, consistent, repeatedly accurate shooting.

Among features lacking in the known art but found in the new archery arm guard are independent adjustability in at least three planes of direction, noise damping features, adjustability to accommodate finger shooters versus release shooters or the degree (the extent) of adjustability presently offered. For example, the new arm guard uses a block or cube to mount a cylindrical vertical bar or rod to a rearward extension so that the vertical bar can be moved horizontally up to approximately five inches forward or rearwardly adjacent to the shooting string.

Accordingly, it is among the several advantages of the present invention to provide a device to aid in positioning the bow arm of an archer during aiming and shooting of an arrow with a bow, and particularly with a compound bow. The new arm guard device is intended to be independently adjustable in several directions in its position mounted to a bow in order to assure preferred placement of the archer's bow supporting arm, to thereby enhance accuracy of shooting, as well as to protect the arm from injury caused by the recoiling bow string and from stress on the elbow joint caused by unnecessary torque placed thereon.

It is further among the several advantages of the invention that the new arm "guard" or positioning device be easily mounted to any of a number of styles of compound bows using only one or two simple hand tools, and requiring little or no instruction. Moreover, since very little strength is required, mounting and adjustment of the new arm guard device can be readily accomplished by most persons, and certainly by anyone with sufficient upper body strength for shooting of a compound bow.

It is also among the advantages of the new device that it is inexpensive to manufacture and consists of only a few facile interconnecting parts which can be readily adapted for attachment to effectively any style of compound bow, and which is also useful as a convenient and comfortable handle for carrying the bow during transport, for example from a vehicle to a hunting site.

Thus, in furtherance of the above objects, the invention is, briefly, a device for attachment to an archery bow to facilitate placement of the bow arm of the archer, the device includes a plurality of pieces adapted for attachment to the bow and movably interconnected to one another in such manner as to be adjustable in at least three different directions, to an individual archer's preferred position on the bow, whereby the archer can optimally position the archer's bow-supporting arm relative to the device to enhance shooting performance and to prevent contact of the bowstring with the archer's bow-supporting arm.

The plurality of pieces of the invention further include, briefly, a straight rod and bent rod and a mounting block mounted horizontally on the first rod when the bow to which the device is attached is held in normal shooting position. The mounting block has a through-bore for receiving and retaining the straight rod, and a through-bore for receiving and retaining the bent rod substantially perpendicularly to the straight rod.

The straight rod of the invention has two opposed ends, one end extending forwardly and the other end extending rearwardly toward the archer, and further wherein the forwardly directed end is pivotally connected to the bow so as to be selectively adjustable in an arc extending upwardly and toward the archer's bow-supporting arm and downwardly, toward the bowstring to thereby permit the archer to position the second rod substantially vertically and at a distance spacedly in relation to the bowstring which provides a guide for accurate and consistent placement of the archer's bow-supporting arm.

The mounting block of the invention is, briefly, radially pivotally adjustably mounted upon the straight rod, so that as the straight rod is pivotally positioned on the bow, the resultant angular shift in the upright position of the bent rod can be compensated for by pivoting the mounting block on the straight rod, to thereby provide structure by which the bent rod can be maintained in a substantially vertical position, substantially parallel to the unstretched bowstring as a guide for accurate and consistent positioning of the archer's bow-supporting arm.

Other advantages will be in part apparent and in part pointed out hereinbelow.

BRIEF DESCRIPTION OF THE DRAWINGS

FIG. 7 is an exploded perspective view showing the arm guard of FIG. 5 attached to a different known style of bow as shown in phantom and having a built-in cable guard.

FIG. 8 is an exploded perspective view showing the arm guard of FIG. 5 attached in a first alternative manner to the style of bow shown in FIG. 1.

FIG. 9 is an exploded perspective view showing the arm guard of FIG. 5 attached in a second alternative manner to the style of bow shown in FIG. 1.

Throughout the drawings like element numbers are used to refer to like parts.

DESCRIPTION OF PRACTICAL EMBODIMENTS

With reference to the drawings, 10 generally designates an archery arm guard constructed in accordance with and embodying the present invention. Arm guard 10 consists of an assembly of preferably metal blocks and rods movably interconnected and adapted for facile adjustable, removable attachment to a compound bow, such as that indicated generally, for example, at B. The new arm guard 10 is constructed especially for aiding the archer in properly positioning his or her arm in relation to the bow and the bowstring S to enhance shooting accuracy as well as to protect the arm from the recoiling bowstring, by virtue of the arm being positioned out of the line of string recoil, and by some physical barrier being provided by the various parts of guard 10.

Figure 1:
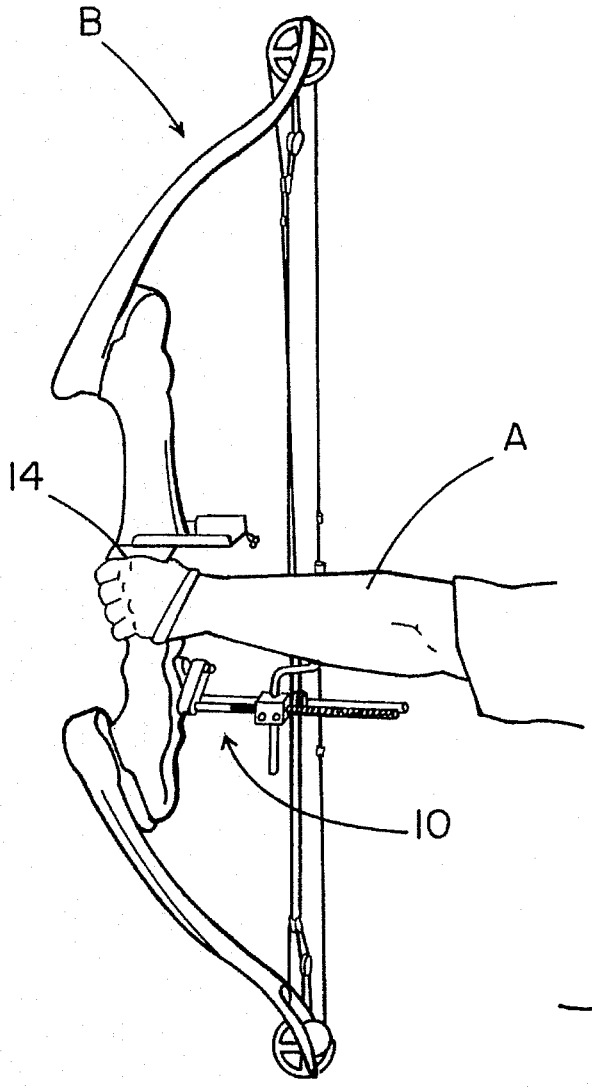
FIG. 1 is an elevational view of an arm guard attached to a compound bow held in an archer's left hand and shown from the archer's left side, the arm guard being constructed in accordance with and embodying the present invention.
Figure 2:
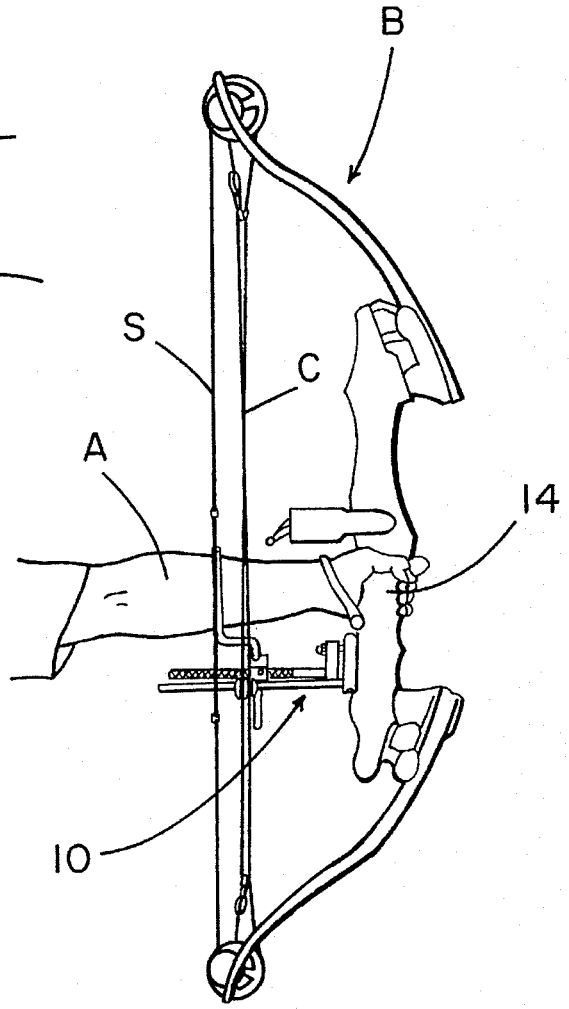
FIG. 2 is a right side elevational view of the arm guard and bow of FIG. 1.

For purposes of simplicity, in this description it will be assumed that the archer, whose arm A is shown outstretched in FIGS. 1 and 2 holding bow B, is righthanded. However, it will be clear upon study of the drawings of this application, and the description related thereto, that arm guard 10 can also be just as readily used by a left handed-archer holding the bow in the right hand and shooting by manipulating the strings with the left hand.

Throughout this discussion it will be understood that "back" or "rear" refers to the side of the bow facing the archer when the bow is held in normal shooting position, as illustrated in FIGS. 1 and 2. "Front" will indicate the side of the bow seen when one is facing the archer holding the bow in the manner shown in FIGS. 1 and 2.

Bow B is of a well known compound type having an elongated body portion and with a normally threaded aperture 12 (shown in FIGS. 4, 6, 8 and 9) which is usually formed entirely through the bow, from front to back, just below the grip portion 14 of the bow. Aperture 12 is ordinarily used for the purpose of mounting various commercially available accessories in known manner. Thus it provides a convenient mounting site for arm guard 10, as will be further explained hereafter.

FIGS. 1–4 illustrate one preferred embodiment of the arm guard/positioner 10 in which a specially designed cuboid mounting block 16 (to be described in detail later herein) is movably mounted upon a shaft or straight rod 18 and receives and retains an elongated bent rod 20 therein. Variations of other portions of guard 10 will occur and alternatives of different parts can be selected individually, or as part of a kit particularly designed for use with specific bow types, as will be clear in view of the description hereafter.

Elements 16, 18 and 20, which are described in detail hereafter, are present in each of the embodiments of the invention and in each case the rods are preferably formed of hardened steel and the cuboid block as well as other blocks shown and to be described are preferably formed of aluminum. Other materials will suffice for formation of the parts of the new arm guard but are not considered to be as generally satisfactory when considering all factors, including wear, performance, expense and ease of manufacture.

As shown, straight rod 18 is preferably knurled along the greater portion of its length and extends continuously from a knurled, rearwardly disposed end 18*a* through cuboid mounting block 16 to unknurled, smooth forwardly disposed end 18*b*. When arm guard 10 is in normal use position as shown, rod 18 is disposed substantially horizontally relative to the ground or other support surface and bent rod 20 is disposed substantially vertically with relation to the ground.

So disposed, rod 20 serves as a positioning guide for the user's arm, as indicated at A in FIGS. 1 and 2. Bent rod 20 also conveniently serves as a reliable and useful handle for carrying or otherwise handling bow B when it is not being held in the normal aiming and shooting position.

Figures 3, 4:
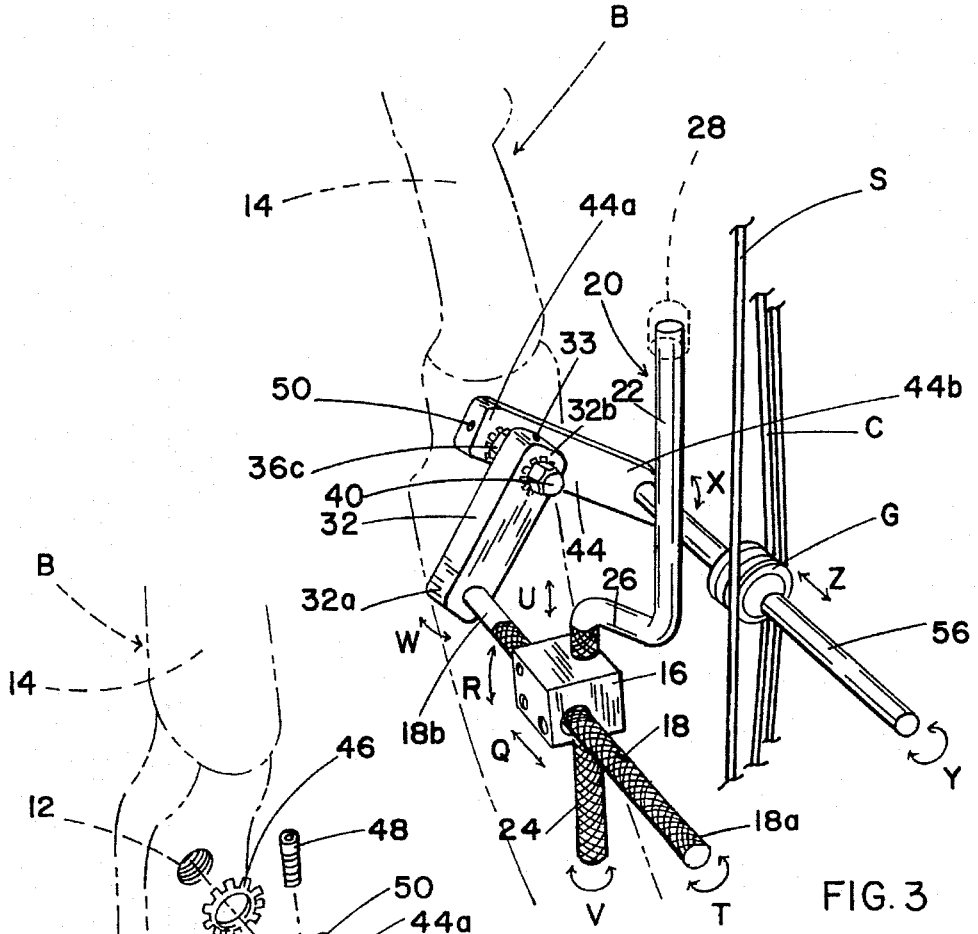
FIG. 3 is a perspective view, close up, of the arm guard of FIG. 1 with the bow shown in phantom.
FIG. 4 is an exploded view of the attachment portions of the arm guard of FIG. 3.

Like straight rod 18, bent rod 20 is preferably formed from five sixteenths inch diameter steel rod. However, rod 20 is bent so as to have a stepped shape, as shown in FIG. 3. As shown in its normal substantially vertical position, rod 20 has an upper straight section 22, a lower straight section 24, the axis of which is parallel to the axis of section 22, and a central straight section 26, which extends between and interconnects sections 22, 24 at approximately right angles. Preferably, upper section 22 is approximately 4.5 inches long, central section 26 is approximately 2 inches long and lower section 24 is approximately 4.5 inches long.

It is understood that some degree of variation from the dimensions specified herein will not interfere with the performance of the new guard 10. Rather, for example, it may be desirable or even necessary to change the length of certain portions of the new alignment and protective device 10 for use by archers of different sizes and shapes and using bows of different sizes and styles. Moreover, other features may also vary somewhat as desired or necessary. For example, upper straight section 22 of rod 20 may conceivably be provided with some other shape, such as a gentle curve, although the form shown is preferred. Also, straight rod 18 could be provided with a knurled surface over its entire length, including the forwardly directed end which journals in block 32.

If desired, a rubber cap 28 (shown in phantom in FIGS. 3 and 9) can be provided at the uppermost tip of section 22 in order to provide some noise damping effect should the above-mentioned, optional metal release aid strike section 22 before or during drawing of the bowstring.

Preferably, upper section 22, which may contact arm A, is provided with a smooth outer surface for comfort and lower section 24 is provided with a knurled outer surface for enhanced retention in its preselected position in block 16. When positioned for use, and as shown in the figures, rod 20 is positioned upright, to the left of and adjacent to bowstring S, with sections 22,24 substantially parallel thereto.

Thus, as illustrated in FIGS. 3, 5 and 7–9, when rods 18,20 are adjustably journalled in their respective retention sites in cuboid mounting block 16 the longitudinal axes of these rods (i.e. the long axis of either straight section 22,24 of rod 20) are always set in relation to each other at substantially 90°. This preferred relative relationship between the two rods 18,20 is maintained by virtue of their retention in their respective receiving positions in cuboid mounting block 16, which will be described in greater detail later with reference to FIGS. 10–16.

With bow B held in normal shooting position as shown in FIGS. 1 and 2, straight rod 18 extends forwardly, substantially horizontally, from its rearwardly directed end 18*a*, through mounting block 16 and terminates in forwardly directed end 18*b*. With reference to FIGS. 3 and 4, forward end 18*b* is received and retained in an aperture 30 formed through a leftwardly-directed end 32*a* of an elongated block 32 from one flat side surface thereof to an opposite flat side surface. Aperture 30 may be provided with a smooth inner surface as seen in FIG. 4, in which case end 18*b* is similarly smooth surfaced. Alternatively, the aperture may be threaded as shown at 30' in the embodiment shown in FIG. 6, in which case end 18*b* will bear corresponding threads (not: shown).

Once received in through-hole 30 rod end 18*b* is retained in a preselected position preferably by use of a set screw, such as that indicated, for example, at 35 in FIG. 4, which penetrates end 32*a* via a small hole (not shown) having a longitudinal axis perpendicular to and intersecting the longitudinal axis of through-hole 30, and parallel to the longitudinal axis of block 32. Thus, set screw 35 can bite into rod end 18*b* and thereby discourage radial and longitudinal movement of the rod.

At the opposite end 32*b* of block 32 there is formed a second through-hole 34, parallel to through-hole 30. Through-hole 34 receives therein a normally rearwardly directed, threaded end 36*a* of a mounting stud 36 by which arm guard 10 is mounted to bow B. Preferably a set of washers, such as those shown at 38, for example, are mounted coaxially on stud end 36*a*, one on each side of block end 32*b*. Threaded stud end 36*a* is capped by a nut 40, which to prevent clothing snags and for improved appearance may be of the acorn variety shown. Of course, other washer and cap styles will suffice.

As seen in FIG. 4, the forwardly directed end 36*b* of mounting stud 36 is also desirably threaded. End 36*b* extends from a nut 36*c*, which is fixed centrally and coaxially on stud 36, forwardly and through a through-hole 42 formed in the normally left-wardly directed end 44*a* of a second elongated block 44, which is approximately the same size as elongated block 32; i.e., about 2 and ¾ inches long, by about ¾ths inch by about ½ inch. Also, like block 32, block 44 is desirably provided with smooth, rounded corners at each of its opposed ends, to thereby prevent inadvertent cuts and clothing snags.

FIG. 4 shows that mounting stud end 36*b* continues forwardly and penetrates aperture 12 in bow B, just below grip 14, so that in use the archer's arm A extends in a horizontal plane above the level of straight rod 18 and approximately parallel thereto, as shown in FIGS. 1 and 2.

As shown in FIG. 4, washers such as those indicated at 46 coaxially flank block end 44*a* on forwardly directed stud end 36*b* which is threadably engaged to bow B via aperture 12. A set screw 48 is threadably received into a screw hole 50 which penetrates block end 44*a* preferably coaxially with the central longitudinal axis of block 44 and perpendicularly intersecting through-hole 42 to bitingly engage and secure threaded stud end 36*b* in a preselected position in block end 44*a*.

In like manner, a similar set screw 52 is received by another screw hole (not seen) at the opposite end 44*b* of elongated block 44, preferably parallel to the central longitudinal axis of block 44. This screw intersects a through-hole 54 which is formed parallel to through-hole 42 for receipt and retention of the forwardly directed end of a cable guard bar 56 and prevents longitudinal and radial movement thereof. If desired, through-hole 54 and the bar 56 end journalled therein may be correspondingly threaded, as shown, or, alternatively, provided with smooth walls for a pressed-in fit. As illustrated in FIG. 3, bar 56 coaxially carries a known annular cable guard G which is provided with annular grooves for receiving and guiding the compound bow cables C.

Thus, with the enumerated elements interconnected as described above, facile adjustment of the parts to suit the needs of the user is available to a very wide extent, as indicated by the arrows shown in FIG.3. Cuboid mounting block 16 can slide axially on rod 18 in either direction, front to back, as shown by arrow Q, and can turn radially on rod 18 as shown by arrow R. Straight rod 18 can turn radially within its mounting site in aperture 30, as shown by arrow T in FIG. 3.

Bent rod 20 can be adjusted longitudinally within mounting block 16, as shown by arrow U, and can be rotated radially therein as shown by arrow V.

Elongated block 32 can pivot on stud 36 so that end 32*a* moves in the directions shown by arrow W. Similarly, elongated block 44 can pivot on stud 36 as indicated by arrow X. Known cable guard bar 56 can move radially, as shown by arrow Y and cable guard G mounted thereon can move longitudinally coaxially thereon as shown by arrow Z.

Figure 5:
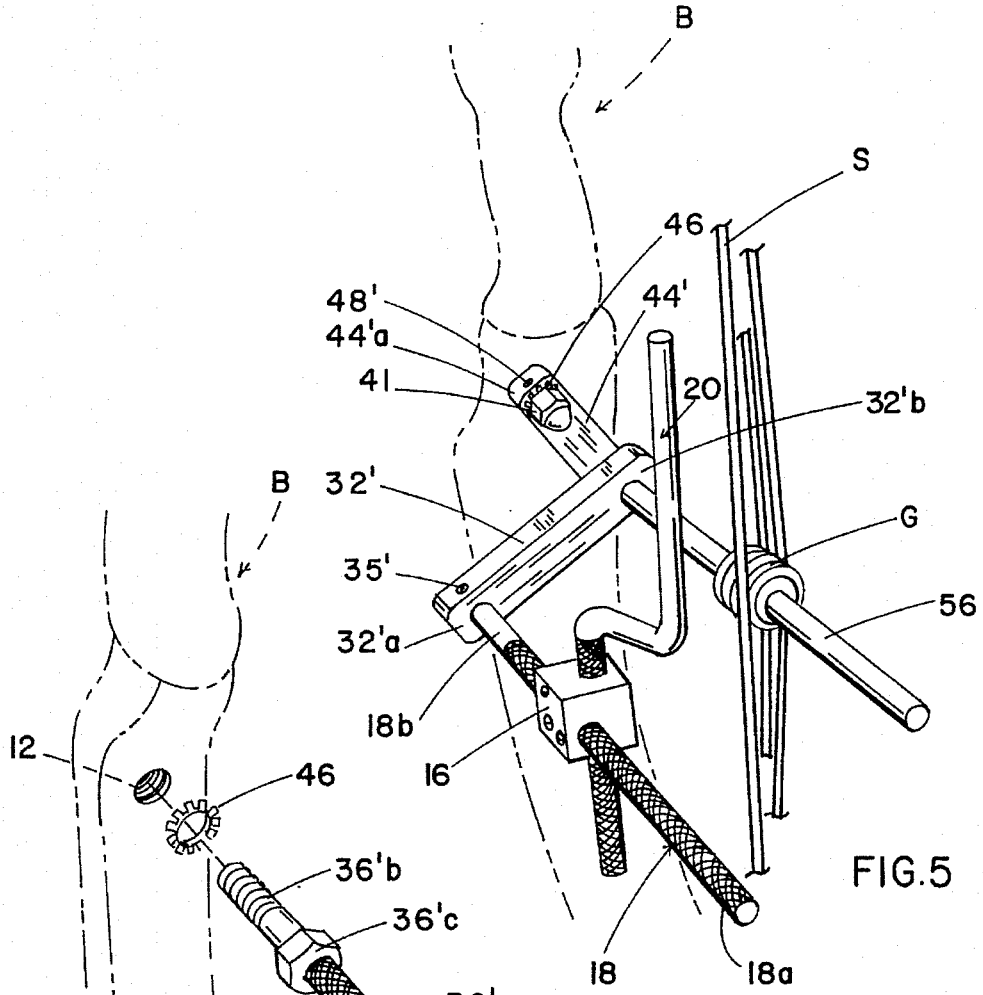
FIG. 5 is a perspective view, close up, showing a first alternative embodiment of the arm guard of FIG. 1, the bow shown in phantom.
Figure 6:
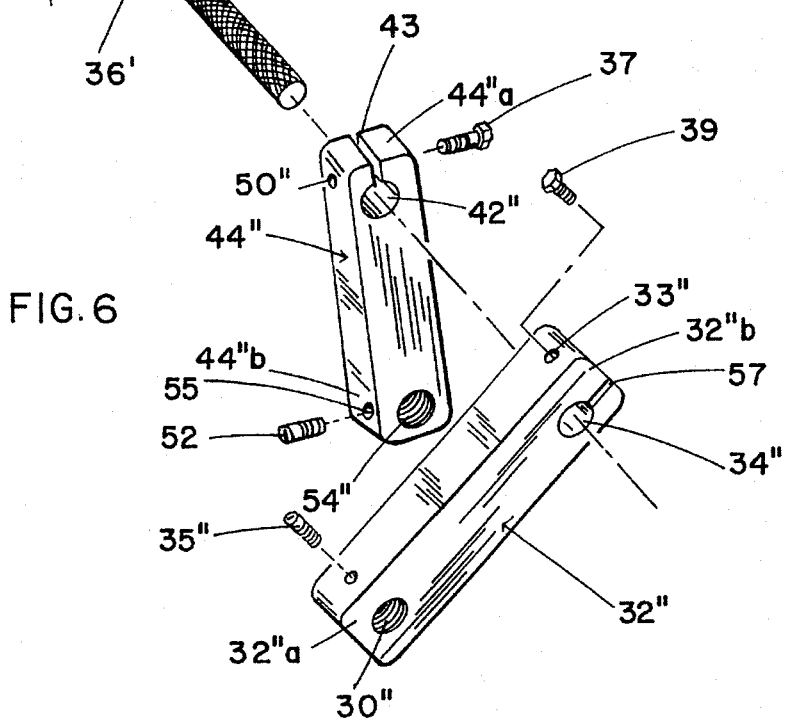
FIG. 6 is an exploded perspective view showing a second alternative embodiment of the arm guard of FIG. 1, the bow shown in phantom.

FIGS. 5 and 6 illustrate alternative embodiments of arm guard 10 wherein variations in mounting structure are provided for use with different styles of bows and to suit the needs of different archers.

More specifically, FIG. 5 shows an alternative embodiment of arm guard 10 wherein mounting block 16, straight shaft 18 and bent rod 20 are identical to those described with reference to FIGS. 3 and 4 and thus are numbered identically. However, the elongated mounting blocks 32',44' vary somewhat from those previously described, and mounting stud 36 is lacking entirely. In this embodiment block 44' is factory installed as part of a "90 degree" cable guard; i.e., cable guard bar 56 is connected at a 90° angle to the longitudinal axis of elongated block 44' and installed on the bow during manufacture thereof. Thus, elongated block 44' is connected directly to bow B by an acorn headed bolt 41 which penetrates block end 44'*a* and is ordinarily separated therefrom by a washer 46. A set screw 48 secures bolt 41 in place, as in the previous embodiment.

However, in the embodiment of FIG. 5, the forwardly directed end of cable guard bar 56 rotatably penetrates and passes forwardly through rightwardly directed end 32'*b* of elongated block 32', at approximately a right angle to the longitudinal axis of the block, prior to being journalled in rightwardly directed end 44'*b* (hidden from view in the figure), also at a right angle thereto, in like manner as the previous embodiment. In other words, the rightwardly directed end of block 32' attaches pivotally to rod 56 rearwardly of the rightwardly directed end of block 44'. By comparison, in the prior embodiment, rightwardly directed end 32*b* was connected to and pivoted coaxially with the leftwardly directed end 44*a* of elongated block 44.

The leftwardly directed end 32'*a* of mounting block 32' receives and retains therein smooth, forwardly directed end 18*b* of rod 18, which extends rearwardly from block 32' for adjustable support of block 16. Rod 18 is secured in a correspondingly sized through-bore formed from front to back in block end 32'*a* by a set screw 35' which penetrates block end 32'*a* to transversely intersect and lock rod end 18*b* in place and prevent radial, as well as longitudinal movement thereof.

Accordingly, because elongated block 32' must necessarily cross a greater distance in order to support straight rod 18 and bent rod 20 to the left of bowstring S and cables C, block 32' is longer in this embodiment than in the first. For example, in this embodiment block 32' is preferably 4 inches by one half inch by three quarter of an inch, with rods 56 and 18*b* perpendicularly intersecting and penetrating the wider, three quarter inch sides, adjacent to block ends 44'*a*,44'*b*, respectively. Of course the length of the various parts can be adjusted somewhat as necessary for the particular archer's needs.

The embodiment of FIG. 6 is best understood relative to the first embodiment by comparing the structure shown and to be described with that shown in FIG. 4. Thus, viewed from the upper left of FIG. 6 and moving to the lower right, it will be seen that bow B is the same and has a similar aperture 12 for receipt of the threaded, forwardly directed end 36'*b* of mounting bolt 36', upon which end there is preferably mounted a coaxially disposed washer 46. The stud bolts vary between the two embodiments. A similar stud bolt center 36'*c* is fixed between threaded end 36'*b* and rearwardly directed end 36'*a* which in this case is knurled rather than threaded.

Knurled end 36'*a* extends rearwardly and has elongated block 44" selectively rotatably mounted thereon. Block end 44"*a* is provided with a through-bore 42" extending from front to back in working position for receipt and retention of knurled end 36'*a* of mounting stud 36'. A straight cut 43 extends along the entire length of smooth-walled through-bore 42", preferably along the central longitudinal axis of block 44", outwardly, to the exterior of the block so that by tightening of a bolt 37 in aperture 50", transversely in relation to cut 43, block end 44"*a* can be squeezed around stud end 36'*a* to secure block 44" in its position at any preselected angle relative to the horizontal.

A cable guard bar (not seen in this view, see, e.g. 56 in FIG. 5) is mounted in an optionally threaded through-bore 54" which also extends from front to back, usually substantially entirely through block 44". A set screw 52 is provided to maintain the cable guard bar in its desired position within the block. Screw 52 enters block end 44"*b* through a screw hole 55, shown in FIG. 6, which penetrates the block perpendicular to the longitudinal axis thereof and transversely communicates with through-bore 54".

FIG. 6 also illustrates a similar construction for the rod 18 mounting block 32" as just described for the cable guard mounting block 44". Thus, one end 32"*b* has a through-bore 34" from front to back for receipt of knurled end 36'*a* of mounting stud 36', rearwardly of block 44". Through-bore 34" is similarly, preferably provided with a smooth sided internal side wall, rather than being threaded, and is in communication with the exterior of block 32" via a straight cut 57, which extends from the bore, outwardly and longitudinally relative to the block, to the exterior thereof. Also similarly, a bolt 39 in screw hole 33" transversely penetrates through end 32"*b* and squeezes block end 32"*b* around knurled stud end 36'*a* to secure block 32" in its preselected angular position relative to the horizontal.

FIGS. 7–9 show a variety of ways in which arm guard 10 can be mounted to a compound bow, depending upon the bow style and the selection of other commercially available equipment in use by the archer. In each case, cuboid mounting block 16, straight rod 18 and bent rod 20 are identical to those described in the embodiments shown and described with reference to the previous figures. However, the connections to the bows shown in FIGS. 7, 8 and 9 vary.

More specifically, FIG. 7 shows a bow B' which is an example of a commercially available bow type and varies from bow B, discussed previously, by having a built-in cable guard bar 56' mounted on an extension E of the bow, spacedly disposed to the right of accessory mounting hole 12'. In this case guard 10 is mounted directly to the factory installed bar 56', which slidably penetrates through-bore 72 formed at the rightwardly directed end 74*a* of a mounting block 74.

As in the previous embodiments, mounting block 74 is elongated and preferably has rounded corners and a generally rectangular cross-section in both the longitudinal and transverse directions thereof. Like block 32' in FIG. 5, elongated block 74 may be somewhat longer than block 32 because it must pass over a greater transverse distance to adequately space rod 18 to the left, away from the bowstrings, not shown.

Elongated adjustment block 74 can be mounted to the cable guard bar 56' and straight rod 18 in like manner as described with regard to any of the previous embodiments. However, it is preferred, as shown, that through-bore 72 and cable guard bar be smooth surfaced and that securement of the two parts together be effected by insertion of two set screws 76, 78 at an approximately right angle to each other and to the through-bore. Desirably, as shown, through-bore 72 may be formed with a center point thereof slightly offset from the central longitudinal axis of the wide, rearwardly and forwardly facing opposed sides of block 74, for optimal placement of set screws 76,78.

As seen, for example, in FIG. 7, straight bar 18 mounts to the leftwardly directed end 74*b* of bar 74 in identical manner as shown in the embodiment of FIG. 5. Of course, straight bar 18 and the connection thereof to block 74 may vary in construction as described with regard to the previous embodiments.

FIGS. 8 and 9 illustrate alternative methods of attachment of guard 10 to bow B and have in common all of the various parts show. The illustrations vary only in the order of interconnection of certain of the attachment parts.

FIG. 8 shows elements 16,18 and 20 which are common with all embodiments of the invention. Elongated mounting block 74 is identical to that shown in FIG. 7, and is similarly be provided with smooth-walled through-bores. The length of block 74 can be varied as necessary to suit the particular bow and archer using such bow.

In this example the commercially available accessory mounting bar (cable guard bar) 80 has an off-set form. The rearwardly extending shank 82 of bar 80 is straight and smooth, and the forwardly directed end 84 has mounted thereon a nut 86 with a forwardly directed externally threaded coaxial extension 88 upon which elongated block 74 is mounted by penetration of through-bore 72 from front to back and tightening of set screws 76,78. Washers such as the type shown at 46 are desirably positioned on each of the front and back sides of block 74, coaxially on threaded extension 88. A set screw 81 is preferably used to secure nut 86 on end 84 of the cable guard bar 80.

FIG. 9 shows an identical arrangement of parts for guard 10 as in FIG. 8, except that the mounting nut 86 and externally threaded extension thereon are disposed forwardly of block 74, coaxially with through-bore 72, rather than behind the block.

Accordingly, it is seen that the new archery arm guard is highly adaptable for use in a great number of potential arrangements in order to suit the needs of the individual archer or as required for use with different styles of bows. The fully adjustable characteristics provided by the particular shape and interconnection of the parts discussed provides a higher degree of usefulness than known with any previous style of archery arm guard.

Figure 15:
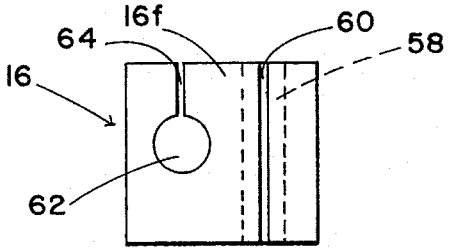
FIG. 15 is a bottom plan view of the mounting block of FIG. 10 from the direction of FIG. 14, then rotated forwardly 180°.
Figure 16:
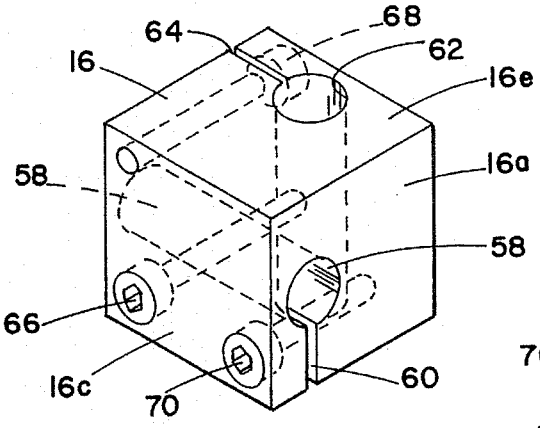
FIG. 16 is a top perspective of the mounting block of FIG 10. from the rear, the archer's normal use position.
Figure 17:
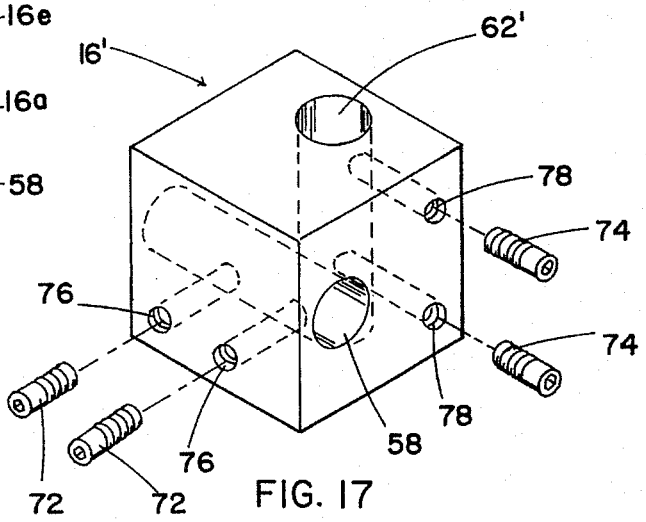
FIG. 17 is a perspective view of an alternative embodiment of the mounting block of FIG. 10.

FIGS. 10–16 illustrate cuboid mounting block 16 in detail and FIG. 17 shows an alternative embodiment thereof, indicated generally at 16'. The six preferably equal area sides of mounting block 16 are indicated by element numbers **16*a* through 16*f*, and in the preferred embodiments illustrated are approximately one inch square. As is explained in greater detail hereafter, a unique and specific arrangement of two through-bores with straight, sidewall cuts in communication with the exterior of the mounting block and a simple arrangement of bolts penetrating the block (or set screws, if the straight cuts are omitted) permit facile selectively releasable adjustment of the longitudinal and radial positions of rods 18, 20 within block 16**.

Figure 10:
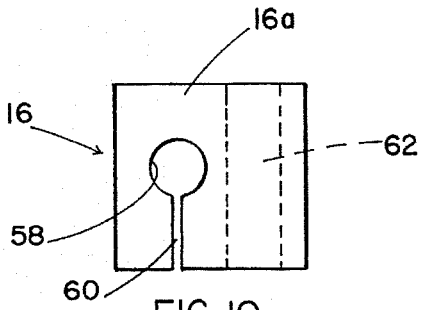
FIG. 10 is a back elevational view of the mounting block of the arm guard of FIG. 1, from the view point of the archer holding the bow in normal use position.

FIG. 10 shows mounting block side **16*a*, the side facing the archer when holding bow B in normal use position with guard 10 mounted thereon in the normal position for use, as in FIGS. 1 and 2. To the left of the approximate center of side 16*a* is seen a through-bore 58 in which straight rod 18 is adjustably longitudinally journalled and disposed substantially horizontally when device 10** is fully assembled and disposed in the normal use position.

Block 16 is provided with a straight cut or split 60 which extends contiguously along the length of through-bore 58 and outward therefrom so that through-bore 58 is in communication with the exterior of block 16 completely along side **16*f*, as shown in FIGS. 10 and 15. Split 60 is for the purpose of allowing block 16 to be tightened upon rod 18**, once the rod is positioned as desired within the block.

FIG. 15 illustrates mounting block side **16*f*, and is a bottom view, relative to side 16*a*, rotated 90° forwardly and then 180° to either side. FIG. 15 also shows through-bore 58 in phantom and illustrates one end of a second throughbore 62 with a split, cut or "channel" 64, similar to that just described with reference to cut 60, so that through-bore 62 is in communication with the exterior of block 16, not only at its open ends, but also along a straight line (cut 64) along block side wall 16*b*, seen in FIG. 11**.

Figure 11:
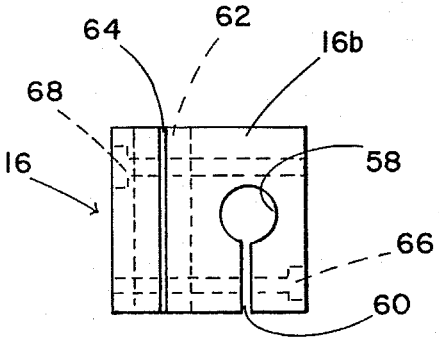
FIG. 11 is a front elevational view of the mounting block of FIG. 10.

FIG. 11 is a front view of block 16, from the view point of a person facing an archer poised as in FIGS. 1 and 2. FIG. 11 also shows the front opening of through-bore 58 and the front end of cut 60. In phantom are indicated alan-headed bolts 66,68 which penetrate block 16 adjacent to surface **16*b* and serve to squeeze block 16 along cut 64, in order to tighten the block upon rod 20 in a preselected position in through-bore 62. A third alan-headed bolt is shown in FIG. 16 at 70**.

Bolt 70 is disposed parallel to bolt 66, both adjacent and substantially parallel to block side surface **16*f*, and tightening thereof causes squeezing of block 16 across cut 60, decreasing the perimeter of through-bore 58 and thus places pressure upon the circumference of normally horizontally positioned straight rod 18 when it is journalled within bore 58. Bolt 66, as shown in FIG. 16 is disposed parallel to bolt 68, both of which are positioned substantially adjacent to wall 16*b* and parallel to each other, although entering block 16 from opposite sides, and, as explained above, tightening of bolts 66,68 necessarily encourages closure of cut 64 to squeeze section 24 of bent rod 20 in through-bore 62, thereby preventing both radial and longitudinal movement of rod 20 within block 16**.

Thus, it is to be understood that by tightening bolt 66 both cuts 60 and 64 are simultaneously squeezed to facilitate securing both rods 18 and 20 in their preselected positions at the same time.

Figure 12:
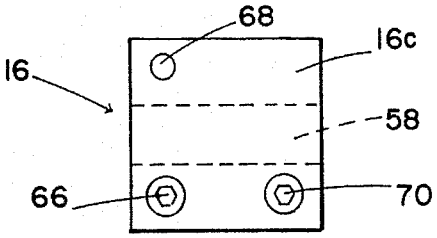
FIG. 12 is an archer's left side elevational view of the mounting block of FIG. 10.

FIG. 12 shows side **16*c* of block 16 with through-bore 58 for rod 18 shown in phantom. Side 16 is normally disposed to the archer's left, as shown in FIGS. 1 and 2. Thus it may be seen that through-bore 58 (shown in phantom) is disposed substantially centrally along the height of block 16, although it is offset from center to the archer's left, as seen in FIG. 10**.

Figure 13:
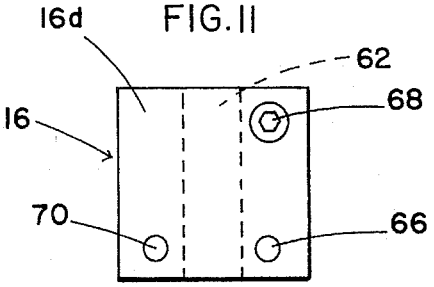
FIG. 13 is an archer's right side elevational view of the mounting block of FIG. 10.
Figure 14:
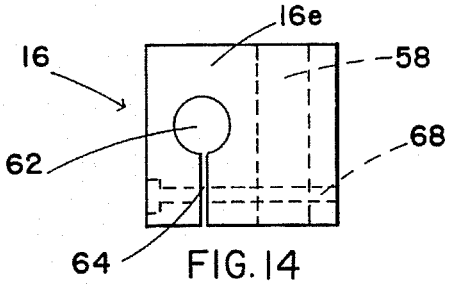
FIG. 14 is a top plan view of the mounting block of FIG. 10 shown from the view point of an individual standing in front of and facing an archer and looking directly downward.

FIG. 13 shows block side **16*d*, from the archer's right, illustrating in phantom that through-bore 62 for receipt and upright support of bent rod 20 is substantially vertically centered in the block, from this view, although offset to the archer's right from top or bottom views of the block. Thus, by the above-described arrangement of through-bores and bolts, with only three bolts both shafts (rods) 18,20 can be adjustably yet securely mounted within cuboid mounting block 16 as part of arm guard 10**.

Alternatively, block 16', shown in FIG. 17, may be used. In this case, through-bores 58', 62' for similar adjustable journalling of rods 18,20, respectively, are not in communication with the outside of the block by means of slits such as those shown at 60,64. Rather, set screws 72 and 74 penetrate block 16', preferably in pairs, via correspondingly sized and threaded paired screw holes 76, 78.

Screw holes 76,78 are in communication at their innermost ends with through-bores 58', 62', respectively, so that set screws 72,74 (which are preferably made of hardened steel) can "bite" into rods 18,20 correspondingly journalled therein to secure the preselected positions of the rods longitudinally within their receiving bores.

With either block 16,16', the positions in the block of through-bores 58,58', relative to bores 62,62', respectively, are important to enable fully adjustable and consistently accurate positioning of rods 18,20 by the archer to suit his or her particular needs.

Accordingly, it is seen that the new arm guard described and shown herein provides a very high degree of adaptability and adjustment for maximum use. The new arm guard can be used by virtually any archer using a compound bow of any known variety, with or without a cable guard or other known attachments to the bow. The particular combination of elements and interconnections thereof make the new arm guard/positioner unique in its variety and ease of adjustability of position on the bow, radially, angularly, fore and aft and vertically.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A device for attachment to an archery bow, the device comprising a plurality of pieces adapted for attachment to the bow and movably interconnected to one another in such manner that at least one of the plurality of pieces is adjustable in at least three different directions, to an individual archer's preferred position on the bow, wherein the plurality of pieces includes a first rod and second rod, the first rod connected to the bow and extending rearwardly therefrom so as to be substantially horizontal when the bow is held in a normal shooting position, and a mounting block rotatably, slidably mounted on the first rod, the mounting block having a first through-bore for receiving and rotatably and slidably retaining the first rod, and a second through-bore for receiving and rotatably and slidably retaining the second rod perpendicularly to the first rod and substantially vertically when the bow is held in a normal, upright use position, whereby the archer can optimally position the archer's bow-supporting arm relative to the second rod of the device to enhance shooting performance and to prevent contact of the bowstring with the archer's bow-supporting arm.

2. The device of claim 1, wherein the first rod has a first end and a second end, the first end extending forwardly and the second end extending rearwardly toward the archer, and further wherein the first end is pivotally connected to the bow so as to be selectively adjustable in an arc extending upwardly and toward the archer's bow-supporting arm and downwardly, toward the bowstring to thereby permit the archer to position the second rod laterally spaced in relation to the bowstring so that the substantially vertical second rod provides a guide for accurate and consistent placement of the archer's bow-supporting arm laterally outwardly in relation to the bowstring.

3. The device of claim 2, wherein the mounting block is radially pivotally adjustably mounted upon the first rod, so that as the first rod is pivotally positioned on the bow, the resultant angular shift in the upright position of the second rod can be compensated for by pivoting the mounting block on the first rod, to thereby provide a means by which the second rod can be maintained in a substantially vertical position, substantially parallel to the unstretched bowstring as a guide for accurate and consistent positioning of the archer's bow-supporting arm.

4. The device of claim 2, wherein the mounting block is longitudinally adjustably mounted on the first rod so that the mounting block can be moved longitudinally on the rod forwardly toward the bow or rearwardly toward the archer as necessary depending upon the archer's bow arm length.

5. The device of claim 1, wherein the first rod and the second rod each have a circular cross-section and wherein the mounting block is cuboid.

6. The device of claim 1, wherein the first rod is straight and the second rod is bent.

7. The device of claim 1, wherein the second rod is formed with a substantially centrally positioned stepped-shaped bend so that a first elongated straight portion and a second elongated straight portion extend from opposite ends of a substantially central straight portion perpendicular thereto and parallel to one another, so that when the device is positioned on the bow which is being held in normal use position and the first elongated straight portion and the second elongated straight portion of the second rod are disposed substantially vertically and the substantially central straight portion is disposed substantially horizontally.

8. The device of claim 7, and further wherein the first elongated straight portion of the second rod is disposed upwardly, above the level of the mounting block.

9. The device of claim 8, and further wherein the first elongated straight portion of the second rod has a smooth outer surface, to prevent irritation of the archer's bow arm upon contact with the first elongated straight portion.

10. The device of claim 7, herein the second elongated straight portion of the second rod is disposed downwardly, through the second through-bore of the mounting block.

11. The device of claim 10, and further wherein the second elongated straight portion of the second rod has a knurled outer surface and threaded connectors penetrate the mounting block to thereby prevent the second rod from moving either radially or longitudinally from a preselected position in the block.

12. The device of claim 11, wherein the threaded connectors are set screws which intersect with the second through-bore and thereby contact and bite into the second elongated straight portion of the second rod within the mounting block.

13. The device of claim 11, wherein the mounting block has formed therein a straight split which is contiguous with the length of the second through-bore and extends outwardly therefrom to the exterior of the mounting block, and further wherein the threaded connectors are bolts which penetrate the mounting block substantially perpendicularly to and adjacent to the second through-bore and perpendicularly to and transversely with relation to the split, to thereby provide tightening of the mounting block around the second rod mounted therein by closure of the split.

14. The device of claim 7, and further comprising a pliable tip disposed on a tip of the first elongated straight portion of the second rod, to thereby dampen any noise which is caused by a release aid striking the device.

15. The combination of an archery bow of the compound variety and an arm guard attached thereto, the arm guard comprising a plurality of pieces adapted for attachment to the bow and movably interconnected to one another in such manner that at least one of the plurality of pieces is adjustable in at least three different directions to a selected position on the bow, wherein the plurality of pieces includes a first rod and second rod, the first rod connected to the bow and extending rearwardly therefrom so as to be substantially horizontal when the bow is held in a normal shooting position, and a mounting block rotatably, slidably mounted on the first rod, the mounting block having a first through-bore for receiving and rotatably and slidably retaining the first rod, and a second through-bore for receiving and rotatably and slidably retaining the second rod perpendicularly to the first rod and substantially vertically when the bow is held in a normal, upright use position, whereby the archer can optimally position the archer's bow-supporting arm relative to the second rod of the device to enhance shooting performance and to prevent contact of the bowstring with the archer's bow-supporting arm.

16. The combination of claim 15, wherein the archery bow further comprises an cable guard bar attached directly to the bow and further wherein the arm guard is selectively adjustably connected to the cable guard bar.

17. An archery tackle kit for providing an arm guard for adjustable attachment to an archery bow adapted for receiving attachment thereof, the kit comprising a plurality of pieces adapted for attachment to the bow and capable of being movably interconnected to one another in such manner that at least one of the plurality of pieces is adjustable in at least three different directions, to thereby permit adjustment of the arm guard to an individual archer's preferred position on the bow, wherein the plurality of pieces includes a first rod and second rod, the first rod connected to the bow and extending rearwardly therefrom so as to be substantially horizontal when the bow is held in a normal shooting position, and a mounting block rotatably, slidably mounted on the first rod, the mounting block having a first through-bore for receiving and rotatably and slidably retaining the first rod, and a second through-bore for receiving and rotatably and slidably retaining the second rod perpendicularly to the first rod and substantially vertically when the bow is held in a normal, upright use position, whereby the archer can optimally position the archer's bow-supporting arm relative to the second rod of the device to enhance shooting performance and to prevent contact of the bowstring with the archer's bow-supporting arm, the pieces of the kit being available in a selection of sizes and attachment styles so that the archer can select the specific sizes and styles desired to form said kit so that it is customized to the archer's particular arm size, right and left handedness and type of bow to which the guard will be attached.

* * * * *